US005381558A

United States Patent [19]

Lo

[11] Patent Number: 5,381,558

[45] Date of Patent: Jan. 17, 1995

[54] GARMENT HAVING MASSAGING PROTUBERANCES

[76] Inventor: Hsin-Hsin Lo, 9, Alley 3, Lane 35, Weitao Rd., N. Dis., Taichung, Taiwan, Prov. of China

[21] Appl. No.: 35,066

[22] Filed: Mar. 22, 1993

[51] Int. Cl.[6] ..... A41B 1/00; A61H 7/00

[52] U.S. Cl. ..... 2/115; 2/69; 2/92; 601/134

[58] Field of Search ..... 2/337, 227, 231, 115, 2/44, 92, 94, 2, 243.1, 69, 113, 114, 108; 606/201, 204; 601/134, 136, 138

[56] References Cited

U.S. PATENT DOCUMENTS

| | | | |
|---|---|---|---|
| 962,900 | 6/1910 | Jordan | 2/113 |
| 1,170,535 | 2/1916 | Hill | 2/337 |
| 1,268,075 | 5/1918 | Glynn | 2/337 |
| 1,500,570 | 7/1924 | Bodnar | 2/231 |
| 1,563,746 | 12/1925 | Hirsch et al. | 2/337 |
| 1,672,325 | 6/1928 | Kintz | 2/337 |
| 2,524,989 | 10/1950 | Payne | 2/231 |
| 2,837,748 | 6/1958 | Manning et al. | 2/337 |
| 3,778,845 | 12/1973 | Miller | 2/236 |
| 4,538,301 | 9/1985 | Sawatzki et al. | 2/2 |
| 4,884,295 | 12/1989 | Cox | 2/44 |
| 4,982,447 | 1/1991 | Henson | 2/44 |
| 5,014,358 | 5/1991 | Matumori | 2/94 |
| 5,033,118 | 7/1991 | Lincoln | 2/115 |
| 5,034,998 | 7/1991 | Kolsky | 2/92 |
| 5,086,519 | 2/1992 | Rokasky | 2/406 |

FOREIGN PATENT DOCUMENTS

| | | | |
|---|---|---|---|
| 445316 | 11/1912 | France | 2/231 |
| 21953 | 11/1894 | United Kingdom | 2/231 |

*Primary Examiner*—Clifford D. Crowder
*Assistant Examiner*—Amy Brooke Vanatta
*Attorney, Agent, or Firm*—Larson and Taylor

[57] ABSTRACT

A device for massaging a body part comprises a plurality of massaging protuberances of various shapes that are attached securely to the inside of a garment. When a person wearing the massage garment sits on a chair or on a bed or couch, the body of the person presses against the massaging protuberances. The resisting force of pressed protuberances works to stimulate the circulatory system and to make muscles or joint supple, so as to relieve pain and tension of the person wearing the massage garment.

3 Claims, 3 Drawing Sheets

GARMENT HAVING MASSAGING PROTUBERANCES

BACKGROUND OF THE INVENTION

The present invention relates to a massage garment capable of bringing about an effect of rubbing and kneading of parts of a wearer's body.

In a modern and industrialized society, people are susceptible to a physical or a psychological illness caused by various factors such as work pressure, social pressure, family problems, traffic congestion, etc. The people are therefore becoming increasingly interested in resorting to non-medical therapy, such as massage, to relieve pain, tension and fatigue. The art of massage is known to be effective on stimulating the circulatory system and making muscles or joints supple. There are a variety of massage apparatus that are available in the market today. However, people often feel that such massage apparatus are not practical in view of the fact that they afford only a temporary relief of pain and tension and that they cannot be conveniently used at any time and at any place.

SUMMARY OF THE INVENTION

It is therefore the primary objective of the present invention to provide a massage garment,which stimulates the blood circulatory system and makes muscles or joints supple, and which can be conveniently put on for any duration at any time and at any place.

In keeping with the principle of the present invention, the foregoing objective of the present invention is attained by a massage garment which is provided with a plurality of massaging protuberances of various shapes that are attached securely to the inside of the massage garment. When a person wearing the massage garment sits on a chair or lies on a bed or couch, the body of the person presses against the massaging protuberances of the garment. The resisting force of the pressed protuberances works to stimulate the circulatory system and to make muscles or joints supple, so as to relieve pain and tension of the person who wears the massage garment of the present invention.

The foregoing objective,structure and function of the present invention will be better understood by studying the following detailed description of a preferred embodiment of the present invention in conjunction with the drawings provided herewith.

DETAILED DESCRIPTION OF THE PREFERRED EMBODIMENT

Figure 1:
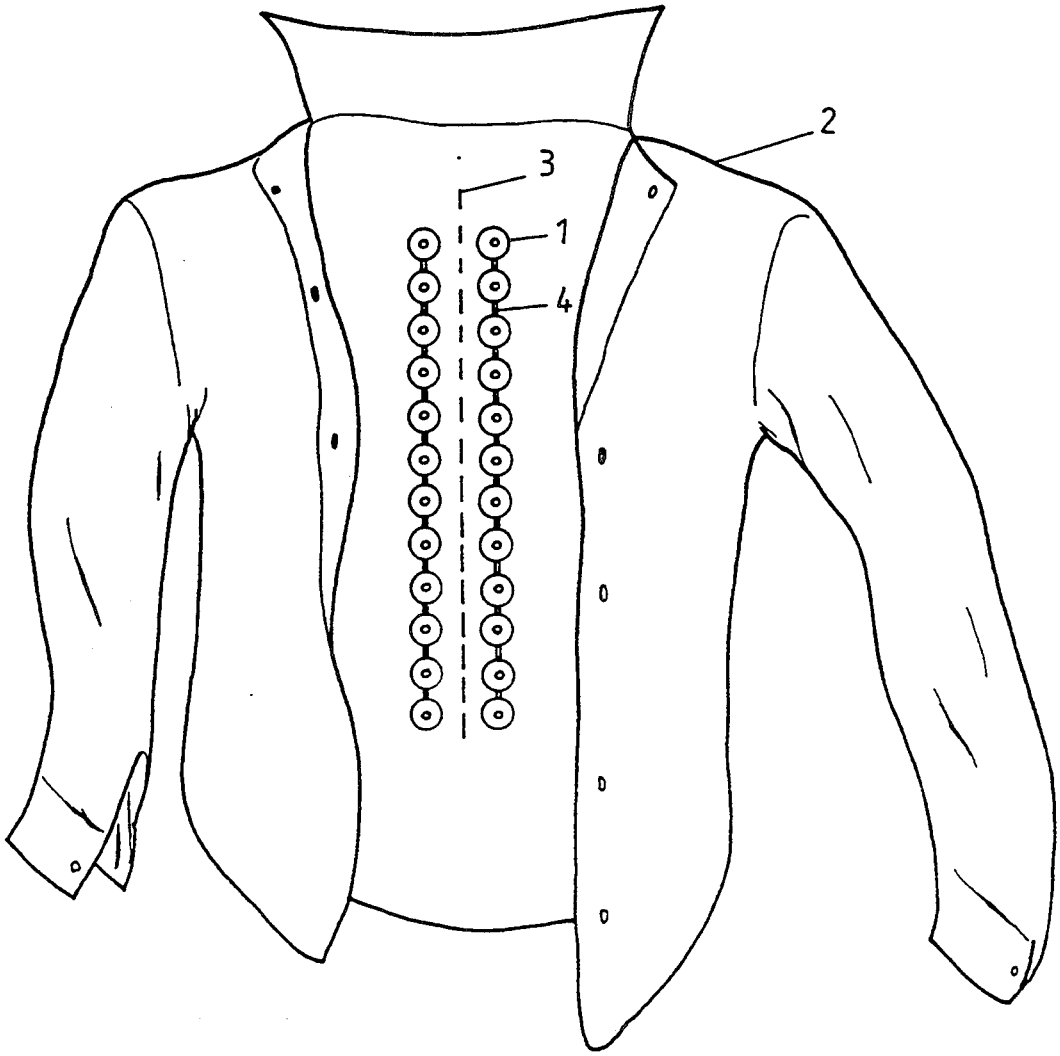
FIG. 1 shows a schematic view of a massage garment provided therein with a plurality of massaging protuberances, according to the present invention.
Figure 3:
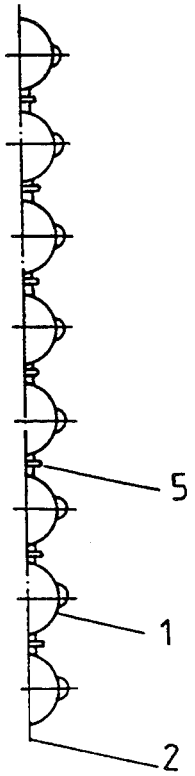
FIG. 3 shows a side elevational view of the massaging protuberances of the present invention.
Figure 2:
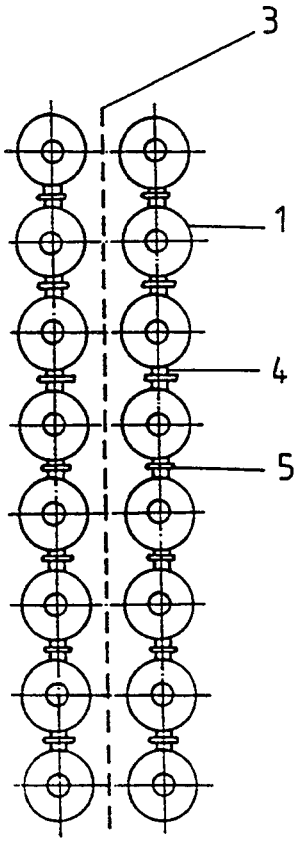
FIG. 2 shows a front elevational view of the massaging protuberances of the present invention.
Figure 4:
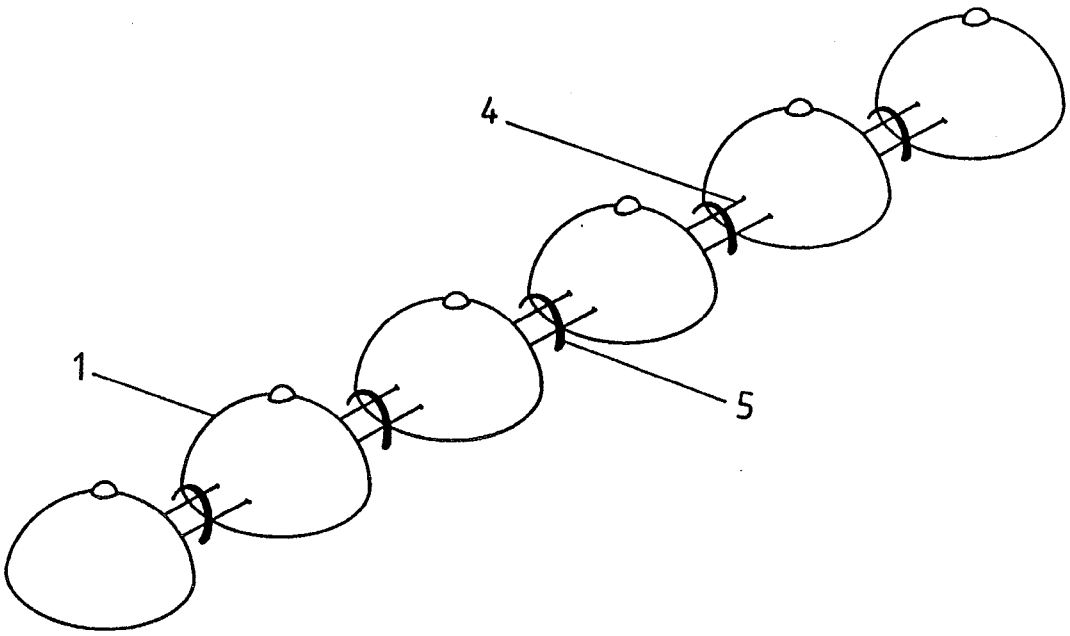
FIG. 4 shows a perspective view of the massaging protuberances of the present invention.

Referring to FIGS. 1,2,3 and 4, a massage garment 2 embodied in the present invention is shown to comprise a plurality of massaging protuberances 1, which are attached securely to the inside of the massage garment 2 in such a manner that they are located in conformity with the main circulatory system of a human body, As shown in FIGS. 1 and 2, the massaging protuberances 1 are so located as to stimulate the circulatory systems on both sides of the vertebral column 3, as indicated by a dotted line. In addition, the massaging protuberances 1 are so located as to stimulate the muscles of shoulder and back. The size and the length of the massaging protuberances 1 are dependent on the size and length of the vertebral column 3. The massaging protuberances 1 are made of a hard and lightweight material. Located between and connecting the two massaging protuberances 1 is a connector 4 of a soft plastic material enabling the massaging protuberances 1 to negotiate the anatomy of the body part intended to be massaged so as to minimize the risk that the massaging protuberances 1 cause a discomfort to the wearer of the massage garment 2. The massaging protuberances 1 are held securely by an elastic fabric 5, which can be detachably adhered to any specific area of the inside of the massage garment 2 that corresponds in location to any specific body part of the wearer intended to be massaged.

The massage garment 2 of the present invention has advantages, which are further elucidated hereinafter.

The massage garment 2 can be worn to massage the body at any time and at any place. For example, a person can enjoy the prospect of being massaged while on a bus, or train, or airplane, or at work , or driving a car.

A person wearing the massage garment 2 of the present invention can be massaged while sitting on a chair or lying on a bed or couch. In addition, the massaging protuberances 1 of the present invention can be easily attached to or detached from an ordinary garment.

The embodiment of the present invention described above is to be regarded in all respects as merely illustrative and not restrictive. Accordingly, the present invention may be embodied in other specific forms without deviating from the spirit thereof. For example, the massaging protuberances 1 embodied in the present invention are intended for use in massaging the vertebral column 3 of a human body. Such massaging protuberances 1 may be modified in other specific forms for massaging the body parts other than the vertebral column 3. The present invention is therefore to be limited only by the scope of the hereinafter appended claim.

What is claimed is:

1. A device for massaging the anatomy of a body part, said device comprising:

a garment;

a plurality of massaging protuberances positioned inside said garment such that said protuberances are located between said garment and a selected body part of a person wearing said device to massage the body part when pressure is applied to said protuberances;

a soft material connecting adjacent protuberances to enable said protuberances to negotiate the anatomy of a body part; and at least one strip of an elastic fabric attached to an inner side of said garment in a form of a closed loop, said elastic fabric being extendable to allow said protuberances to pass through said loop for insertion or removal thereof and retractable for fitting over said soft material and holding said protuberances inside said garment.

2. The device according to claim 1 wherein said protuberances are arranged in two rows.

3. The device according to claim 2 wherein said garment comprises a shirt and said rows of protuberances are positioned in a back of said shirt for massaging a back of a person wearing said shirt.

* * * * *